US011527850B1

(12) United States Patent
Wright et al.

(10) Patent No.: US 11,527,850 B1
(45) Date of Patent: Dec. 13, 2022

(54) CONNECTOR BACKSHELL ASSEMBLY

(71) Applicant: Space Exploration Technologies Corp., Hawthorne, CA (US)

(72) Inventors: Jeremy C. Wright, Los Angeles, CA (US); Kristina T. T. Kellogg, Torrance, CA (US)

(73) Assignee: Space Exploration Technologies Corp., Hawthorne, CA (US)

( * ) Notice: Subject to any disclaimer, the term of this patent is extended or adjusted under 35 U.S.C. 154(b) by 0 days.

(21) Appl. No.: 17/035,560

(22) Filed: Sep. 28, 2020

(51) Int. Cl.

| | |
|---|---|
| ***H01R 13/506*** | (2006.01) |
| ***H01R 13/629*** | (2006.01) |
| ***H01R 13/58*** | (2006.01) |
| ***H01R 13/52*** | (2006.01) |
| ***H01R 43/00*** | (2006.01) |

(52) U.S. Cl.
CPC ..... *H01R 13/62938* (2013.01); *H01R 13/506* (2013.01); *H01R 13/5221* (2013.01); *H01R 13/582* (2013.01); *H01R 13/62955* (2013.01); *H01R 43/005* (2013.01)

(58) Field of Classification Search
CPC ..... H01R 13/62938; H01R 13/506; H01R 13/5221; H01R 13/582; H01R 13/62955; H01R 43/005
See application file for complete search history.

(56) References Cited

U.S. PATENT DOCUMENTS

| | | | | |
|---|---|---|---|---|
| 7,922,503 | B1 * | 4/2011 | Kobayashi | H01R 13/6295 439/157 |
| 9,948,023 | B2 * | 4/2018 | Kida | H01R 13/5213 |
| 10,910,757 | B2 * | 2/2021 | Nakamura | H01R 13/582 |
| 11,128,091 | B2 * | 9/2021 | Kobayashi | H01R 13/639 |

FOREIGN PATENT DOCUMENTS

| | | | | |
|---|---|---|---|---|
| WO | WO-2013115414 | A1 * | 8/2013 | H01R 13/506 |
| WO | WO-2014111133 | A1 * | 7/2014 | H01R 13/5219 |

OTHER PUBLICATIONS

CMC Hybrid Connectors Standard and Power Versions Connector System, Order No. 987650-5254, Year 2011, 24 pages, www.molex.com, Germany.

* cited by examiner

*Primary Examiner* — Tho D Ta
(74) *Attorney, Agent, or Firm* — Polsinelli PC

(57) ABSTRACT

A connector backshell assembly includes a module hood sealable against a connection port having a first connector, a harness hood configured to house a second connector mateable with the first connector, a backshell configured to provide strain relief to a wire harness extending from the second connector and securable on the harness hood after the second connector is housed within the harness hood, and a latch assembly having a latch handle moveable from a first position into a second position to move the harness hood into sealing engagement with the module hood.

20 Claims, 5 Drawing Sheets

CONNECTOR BACKSHELL ASSEMBLY

BACKGROUND

Networked electronic systems often include a number of devices communicating with other devices through a number of associated electrical cables with electrical connectors. Typically, one device is connected to another device or system through a single conductor or multiple conductors that are terminated with contacts in a connector housing. To terminate the conductors to the connector contacts, wire insulation is removed from an end of the cable to expose the conductors therein. The conductors are placed into the contacts of the connector and the conductors are attached thereto, such as with crimping or soldering techniques.

It is common to utilize a backshell on an electrical connector to protect the conductors of the electrical cable, which are connected to the contacts in the connector (hereinafter sometimes referred to as the "wire harness"). The backshell may prevent dust, particles and moisture from entering the rear of the connector. The backshell may also provide strain relief for the cable so that excessive forces applied to the cable will not cause the cable conductors to become disconnected from the contacts in the connector housing.

Embodiments of the present disclosure are directed to improved connector backshells that may be used with D Sub connectors or other similar connectors that are sufficiently robust to withstand a highly dynamic, corrosive (e.g., saltwater) environment, that is easy to assemble/integrate, and that can be used with an assembled wire harness.

SUMMARY

A connector backshell assembly includes a module hood sealable against a connection port having a first connector, a harness hood configured to house a second connector mateable with the first connector, a backshell configured to provide strain relief to a wire harness extending from the second connector and securable on the harness hood after the second connector is housed within the harness hood, and a latch assembly having a latch handle moveable from a first position into a second position to move the harness hood into sealing engagement with the module hood.

A method of sealingly mating a first connector with a second connector of a connection port includes sealing a module hood against a connection port having a first connector, securing a second connector within a harness hood, securing a backshell to the harness hood, securing a wire harness extending from the second connector to the backshell, sealing the second connector and at least a portion of the wire harness within the harness hood, and moving a latch handle from a first position into a second position to move the harness hood into sealing engagement with the module hood.

A D-Sub connector backshell assembly includes a module hood sealable against a connection port having a first D-Sub connector, a harness hood configured to house a second D-Sub connector mateable with the first D-Sub connector, a backshell configured to provide strain relief to a wire harness extending from the second D-Sub connector and securable on the harness hood, and a latch assembly having a latch handle moveable from a first position into a second position to move the harness hood into sealing engagement with the module hood.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
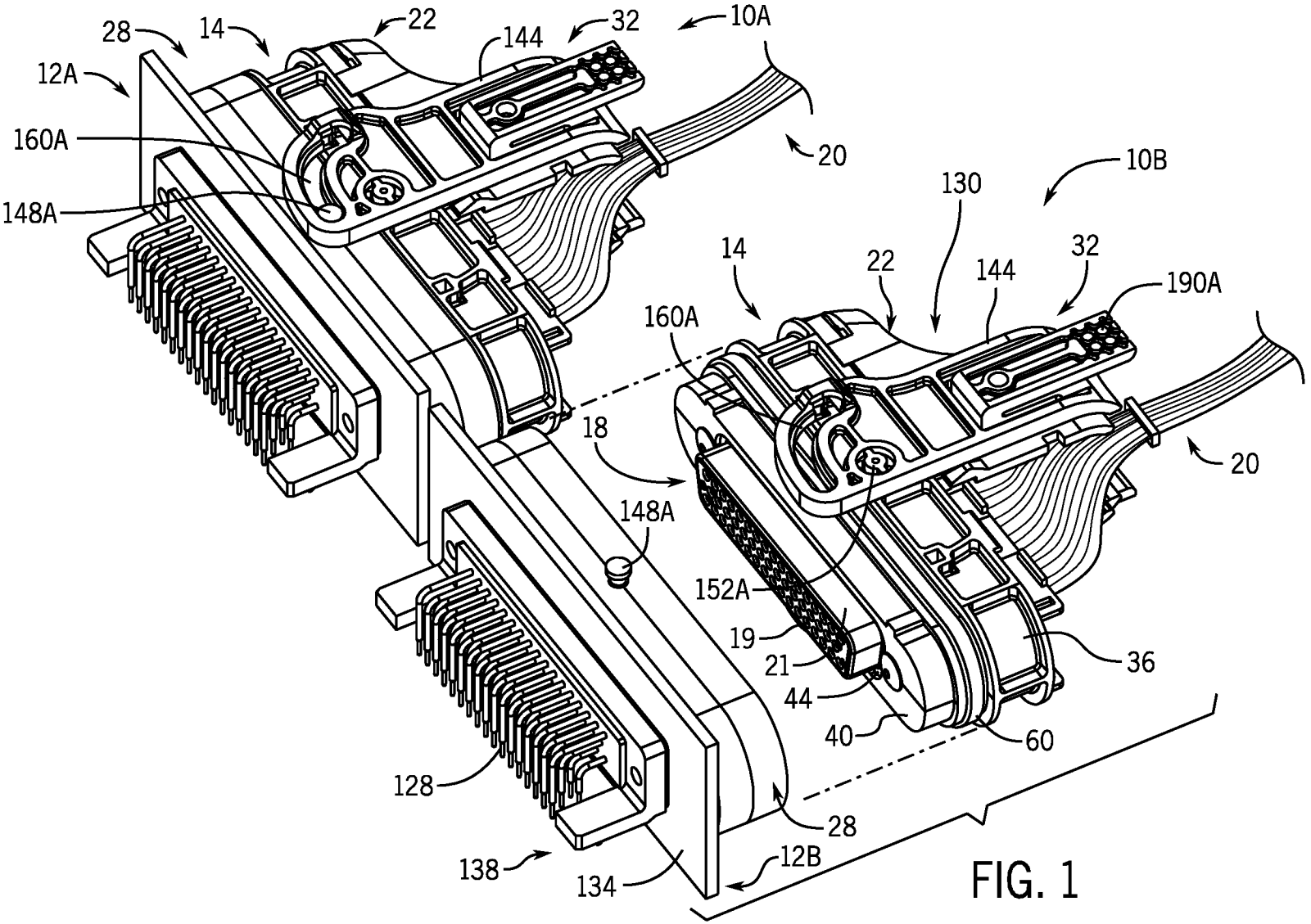
FIG. 1 is an environmental view of a first exemplary embodiment of first and second identical connector backshell assemblies in use with an electrical port, wherein the second connector backshell assembly is shown partially exploded.

Embodiments described and illustrated herein relate to a connector backshell assembly and methods of sealingly mating a first connector with a correspondingly-shaped second connector of a connection port. In general, the connector backshell assembly is an accessory to a widely available, cost efficient, commercial off-the-shelf (COTS) connector assembly (hereinafter sometimes referred to as "COTS connector assembly" or simply "connector assembly"). The term "COTS connector assembly" or "connector assembly" should be understood to mean a pair of mateable (e.g., male and female) connectors each having a pre-terminated or pre-assembled array of conductive contacts (pins or sockets) within a housing. In that regard, the term "connector" should be understood to mean a pre-assembled array of conductive contacts (pins or sockets) within a housing.

Most COTS connector assemblies are not built to withstand a highly dynamic, corrosive (e.g., saltwater) environment. In that regard, the connector backshell assembly configures a COTS connector assembly for use in higher stress applications, such as aerospace applications. However, those skilled in the art will recognize that the embodiments of the invention may be applied to other applications.

Various types of backshells exist for different electrical connectors and/or applications. For instance, in aerospace applications, the connector assemblies are designed to be sufficiently robust to withstand a highly dynamic, corrosive (e.g., saltwater) environment. Therefore, specialized connector assemblies, such as the 38999 type, are typically used. The 38999 connector assembly is a circular connector assembly that may include a threaded style backshell suitable for environmentally sealing, shielding, and mating the connector to a corresponding connector or port. Being circular in design, the 38999 connector assembly also packs densely/compactly in the electronic system, which is beneficial in aerospace applications where space is very limited.

However, these circular connector assemblies are only available from a limited number of vendors, and, as a result, they typically have long lead times and higher costs. Although a threaded or similar mating interface may be easy to use, it is often difficult or time consuming to measure and/or accurately obtain the required torque for mating the connector. A bayonet interface backshell may instead be used, but the undesirable long lead times and higher costs still exist.

Less expensive, more widely available (e.g., functional off-the-shelf), space/piece part efficient (e.g., pack densely/compactly), easy to assemble/integrate connector assemblies are used in other industries, such as a D-sub connector. The backshell for a D-sub connector may include a cast or otherwise formed shell that encloses a rear cable support structure extending from the contacts of the connector (or wire harness), and a coupling ring or grommet to lock the rear cable structure to the connector shell. However, in such a design, the cabling and harness work must be performed after passing the cables through the grommet. In other words, the wire harness cannot be built in parallel or separately from the connector backshell, leading to longer lead times and higher costs.

Traditional D-sub connector backshells are not suitable for environmentally sealing the connector to a corresponding connector or port. Aerospace vehicles (e.g., spacecraft, rockets, etc.) are typically built in harsh environments, like Florida and Texas, where salt water and corrosion can get into a connector. Therefore, without proper sealing, the contacts in the D-sub connector are susceptible to environmental damage. More specifically, a stamped connector such as a D-sub connector has many leak paths, and ingress of water or saltwater can cause damage and degradation to the connector and affects its ability to pass signals and power through the connector contacts. A damaged connector poses a big liability and risk for vehicle operation.

Moreover, traditional D-sub connector backshells use hand-tightened jack screws to mate the connector to a corresponding connector or port. The torque applied using hand-tightened jack screws cannot be easily checked or verified, and there is no indication that the connector has been properly mated. An alternative solution uses spring clips that mate with corresponding features to mate the D-sub connector, however, the spring clips do not provide the same mechanical advantage as the jack screws. Rather, an operator must push the clips into place in order to mate the connector. Moreover, the spring clips provide no indication that the connector has been properly mated. Rather, an operator must visually check to see if the spring clips have engaged the corresponding features, and/or listen for an audible click, which is difficult to do in tightly packed situations. Finally, neither the jack screws nor the spring clips provide any secondary retention that is necessary in a highly dynamic, aerospace environment.

Referring to FIG. 1, first and second connector backshell assemblies 10*a* and 10*b* formed in accordance with an exemplary embodiment of the present disclosure are depicted. The first connector backshell assembly 10*a* is shown connected to a first connection port or module inlet port 12*a*, and the second connector backshell assembly 10*b* is shown disconnected from a second module inlet port 12*b*.

The second connector backshell assembly 10*b* is shown in use with a D sub connector 18 having a plurality of contacts housed within a connector housing. Specifically, the D sub connector 18 includes contact sockets 19 housed within a connector housing 21. The contact sockets 19 are mateable with contact pins of a D-sub connector (only the rear terminating pins 128 shown in FIG. 1) of module inlet port 12*b*. The D-sub connector 18 may instead include contact pins mateable with sockets of a corresponding D-sub connector of module inlet port 12*b*. Moreover, it should be appreciated that the connector backshell assemblies 10*a* and 10*b* may instead be configured for use with any suitable COTS connector. In that regard, the D-sub connector 18 may be simply referred to as "connector 18" or "COTS connector 18".

Each of the connector backshell assemblies 10*a* and 10*b* sealingly mate COTS connector 18 with a corresponding COTS connector of module inlet port 12*a* and 12*b*, respectively. The first and second connector backshell assemblies 10*a* and 10*b* are identical; and therefore, the first and second connector backshell assemblies 10*a* and 10*b* will be generally referred to throughout as a connector backshell assembly 10 mateable to module inlet port 12.

In general, the connector backshell assembly 10 configures the COTS connector assembly (defined by connector 18 and its corresponding connector of module inlet port 12) to be used in a highly dynamic, corrosive (e.g., saltwater) environment, while being easy to assemble/integrate. In the depicted exemplary embodiment, the connector backshell assembly 10 generally includes a harness hood 14 that encloses the connector 18 and a strain relief backshell 22 that is securable to the harness hood 14 to support a wire harness 20 extending from the connector 18. A module hood 28 is securable to module inlet port 12, and the harness hood 14 sealingly connects to the module hood 28. A latch assembly 32 is used to easily mate and unmate the harness hood 14 (together with the connector 18) to and from the module inlet port 12.

Referring additionally to FIGS. 2-5, detailed aspects of the connector backshell assembly 10 will now be described. In particular, the harness hood 14 will first be described in detail. As noted above, the harness hood 14 encloses the connector 18, which, in the depicted exemplary embodiment, is a D sub connector. In that regard, the harness hood 14 has a hollow body 36 that is generally an elongated oval shape, or rectangular in shape with rounded corners, to house the generally elongated, rectangularly shaped connector 18. However, it should be appreciated that the harness hood 14 may instead have any other suitable shape and configuration to house a correspondingly shaped connector.

The connector 18 is receivable within the body 36 and matable against the interior of a front, module hood mating portion 40 such that the connector 18 protrudes from the harness hood 14 for mating with the module inlet port 12. The front mating portion 40 is sized and configured to mate with or otherwise be received within an interior portion of the module hood 28. In that regard, the front mating portion 40 is generally male shaped with an interior portion of the module hood 28 being correspondingly female shaped. A connector opening 44 is defined in a front face of the front mating portion 40 that allows a male-shaped socket assembly 48 (defined by the sockets 19 and housing 21) of the connector 18 to protrude forwardly therefrom.

A flange plate 52 extending substantially transversely from the connector 18 is securable against an interior surface of the front mating portion 40 through a plurality of fasteners, such as blind rivets 56. With the connector 18 secured within the harness hood 14 in this manner, the male-shaped socket assembly 48 of the connector 18 protrudes from the harness hood 14 for mating with a corresponding female-shaped pin assembly of the module inlet port 12 when the harness hood 14 is mated with the module hood 28.

A radial seal 60 is disposed between the harness hood 14 and the module hood 28 for environmentally sealing the connector 18 therebetween. The radial seal 60 may be secured within a correspondingly shaped seal receptacle 64 extending around the circumference of the body 36 of the harness hood 14. In this manner, water and other types of debris cannot leak into the connector backshell assembly 10 at the interface of the harness hood 14 and module hood 28.

As can be appreciated by one of ordinary skill in the art, the connector 18 terminates a bundle of electrical wires at the housed contact sockets 19 for transmitting signals from the wires to a module through the housed contacts of the module inlet port 12. As shown in FIG. 1, a bundle of wires, or the wire harness 20, is terminated at a terminating portion 70 of the connector 18 opposite the socket assembly 48. The terminated ends of the wire harness 20 are environmentally sealed within the harness hood 14 by disposing a sealant, or pottant within the open interior end 66 of the harness hood 14 opposite the front mating portion 40 (see FIG. 3).

The pottant may be disposed within the open interior end of the harness hood 14 opposite the front mating portion 40 after mating the connector 18 to the front mating portion 40, with the wire harness 20 extending rearwardly therefrom. In this manner, the wire harness 20 may be built and terminated at the connector 18 prior to integration of the connector 18 within the connector backshell assembly 10. In other words, the cable bundle does not need to pass through a sealing mechanism, such as a grommet, before being terminated at the connector 18 and integrated within the connector backshell assembly 10.

As noted above, the connector backshell assembly 10 further includes a strain relief backshell 22 configured to support the wire harness 20 of the connector 18. The strain relief backshell 22 is securable to the harness hood 14 in at least one of two mirrored positions (depending on the latch orientation, later described) for providing strain relief to the wire harness 20. As may best be seen by referring to FIG. 4, the strain relief backshell 22 includes a harness hood mating portion 74 releasably securable to the harness hood 14, and a strain relief portion 78 extending substantially transversely from the harness hood mating portion 74 for providing strain relief to the wire harness 20.

In the depicted exemplary embodiment, the harness hood mating portion 74 is generally shaped and configured to slidably mate with the harness hood 14 and releasably lock onto the harness hood 14. In that regard, the harness hood mating portion 74 is of a demi-elongated oval shape having an open end for receiving and mating with the correspondingly shaped harness hood 14.

The harness hood mating portion 74 may slidably and releasably lock onto the harness hood 14 in any suitable manner. In the depicted embodiment, a tool-less, releasable locking interface is defined between the harness hood 14 and the mating portion 74 of the strain relief backshell 22. In particular, the harness hood 14 includes an upper mating flange 82*a* extending substantially rearwardly and transversely from a rear upper end of the body 36 opposite the front mating portion 40. The upper mating flange 82*a* is stepped downwardly from a plurality of horizontal upper mating protrusions 86*a* also extending substantially rearwardly and transversely from a rear end of the body 36. The upper mating flange 82*a* and horizontal upper mating protrusions 86*a* generally define upper and lower bounds of an upper track 88*a*. The upper track 88*a* is further bound at its elongated sides by the rear upper end surface of the harness hood 14 (not shown) and a plurality of upwardly extending, substantially transverse vertical upper mating protrusions 90*a* defined at the rear edge of the upper mating flange 82*a*.

An identical lower track (not shown) is defined on the bottom end of the harness hood 14 opposite the upper track 88*a*. In that regard, the harness hood 14 is substantially symmetrical about a center horizontal plane, and identical features on the bottom half of the harness hood 14 are labeled with identical reference numerals except with a "b" designation. The harness hood 14 is also substantially symmetrical about a center vertical horizontal plane such that the strain relief backshell 22 may be slid into engagement on either elongated end of the harness hood 14, depending on the desired latch orientation. Being substantially symmetrical in the illustrated embodiment, identical features on the left and right halves of the harness hood 14 are labeled with identical reference numerals except with "a" and "b" designations, respectively. Moreover, for brevity, some of the "b" designation features are not described or shown in detail since the identical "a" feature is shown and described. Likewise, some of the "a" designation features are not described or shown in detail since the identical "b" feature is shown and described. Finally, some features may be generally described without the "a" or "b" designation when generally describing the part for both symmetrical halves of the harness hood 14.

The upper track 88*a* of the harness hood 14 is configured to slidably receive a correspondingly-shaped feature on the harness hood mating portion 74 of the strain relief backshell 22. In the depicted exemplary embodiment, the harness hood mating portion 74 includes an upper interior tapered elongated groove 100*a* spaced inwardly from its upper elongated edge. The upper interior tapered elongated groove 100*a* receives the substantially transverse vertical upper mating protrusions 90*a* of the upper track 88*a* as the strain relief backshell 22 is slid into mating engagement with the harness hood 14. Moreover, the upper interior tapered elongated groove 100*a* tapers or narrows in width as it extends away from the open end of the strain relief backshell 22 to help define a friction fit between the strain relief backshell 22 and the harness hood 14.

An upper elongated edge portion 104*a* is defined between the upper interior tapered elongated groove 100*a* and the upper elongated edge of the harness hood mating portion 74. The upper elongated edge portion 104*a* is slidably receivable within the upper track 88*a*. Moreover, an upper exterior elongated groove 106*a* extends along the exterior of the harness hood mating portion 74 to receive the horizontal upper mating protrusions 86*a* as the upper elongated edge portion 104*a* is slid into the upper track 88*a*. In this manner, the upper elongated edge portion 104*a* is retained within the upper track 88*a*, bound by the horizontal upper mating protrusions 86*a* and substantially transverse vertical upper mating protrusions 90*a*.

To secure the strain relief backshell 22 on the harness hood 14, the upper and lower elongated edge portions 104*a* and 104*b* of the strain relief backshell 22 are aligned with the upper and lower tracks 88*a* and 88*b* on the harness hood 14. With the upper and lower elongated edge portions 104*a* and 104*b* aligned with and perhaps partially received within the tracks 88*a* and 88*b*, the strain relief backshell 22 may be slid into mated engagement with the harness hood 14. The upper and lower elongated edge portions 104*a* and 104*b* are slid within the upper and lower tracks 88*a* and 88*b* until the enclosed end of the harness hood mating portion 74 is substantially flush with the enclosed end of the harness hood 14.

Once slidably mated, the strain relief backshell 22 may be releasably locked onto the harness hood 14 in any suitable manner, such as with a snap fit assembly. In the depicted exemplary embodiment, a top snap fit feature 110*a* is defined at the end of the upper elongated edge portion 104*a* near the enclosed end of the harness hood mating portion 74 that is mateable with an upper corresponding opening 114*a* in the harness hood 14. More particularly, a protrusion extends downwardly from a deformable cantilevered end of the upper elongated edge portion 104*a* that is receivable within the opening 114*a* when the strain relief backshell 22 is fully received on the harness hood 14.

The cantilevered end deforms upwardly to allow the protrusion to move into and out of the opening 114*a* for selectively locking the strain relief backshell 22 onto the harness hood 14 and to provide an audible "click" when releasably locked in place. A mirrored bottom snap fit feature 110*b* is defined at the end of the bottom elongated edge portion 104*b* near the enclosed end of the harness hood mating portion 74 that is mateable with a corresponding bottom opening 114*a* in the harness hood 14.

With the strain relief backshell 22 releasably secured on the harness hood 14 in the above described manner or in another suitable manner, the wire harness 20 may be secured within the strain relief portion 78 of the strain relief backshell 22 to relieve any strain in the wire harness 20 and connector 18 during use. For instance, the strain relief portion 78 may include an interior semi-circular receptacle portion 120 against which the wire harness 20 may be restrained. The interior semi-circular receptacle portion 120 is positioned to secure the wire harness 20 in a "straight" position relative to the connector 18; i.e., the wire harness 20 extends substantially straight or transversely from the connector 18. In an alternative connector backshell assembly 200 embodiment shown in FIG. 6, wherein like parts have been identified with like reference numerals except in the '200 series, the interior semi-circular receptacle portion 220 is positioned to secure the wire harness 20 in an "angled" position (such as forty-five degrees) relative to the connector 18.

The wire harness 20 may be secured against the interior semi-circular receptacle portion 120 through a suitable tie, clamp, etc., to relieve any strain that the connector 18 would otherwise endure in the dynamic environment. In the depicted exemplary embodiment, a zip tie or similar device (not shown) may be used to secure the wire harness 20 against the interior semi-circular receptacle portion 120. For instance, with the wire harness 20 positioned against the interior semi-circular receptacle portion 120, each end of a zip tie may be passed through a corresponding opening or through-hole 124*a* and 124*b* in the strain relief portion 78 and thereafter tied off. Accordingly, substantially all pulling, vibration, motion, etc., downstream of the connector will react at the tied off point and will not be transferred into the contact portion of the cables.

After securing the connector 18 and wire harness 20 within the harness hood 14 and strain relief backshell 22, collectively referred to as the backshell connector subassembly 130, the connector 18 is thereafter mated with the corresponding connector of the module inlet port 12. The connector of the module inlet port 12, on its connection side, is sealingly surrounded by the module hood 28. In that regard, the module hood 28 includes a connector opening 132 in its front face for receiving the connector of the module inlet port 12 (and the connector 18, when mated thereto). The connector of the module inlet port 12 may be secured in a connector mounting panel 134 or the like, and the module hood 28 may be secured to the connector mounting panel 134 of the module inlet port 12 with fasteners, etc. (not shown). A seal, such as a radial seal (not shown), may be secured within a correspondingly-shaped groove 136 defined in the front face of the module hood 28. When compressed between the module hood 28 and the connector mounting panel 134, the seal prevents any environmental elements from reaching the module inlet port 12.

The module hood 28 is also configured to sealingly and lockingly interface with the backshell connector subassembly 130. As noted above, the male-shaped front mating portion 40 of the harness hood 14 is sized and configured to mate with or otherwise be received within a female-shaped portion of the module hood 28, with a radial seal 60 disposed therebetween. The backshell connector subassembly 130 is releasably locked onto the module hood 28 through the latch assembly 32.

Referring to FIGS. 1-5, the latch assembly 32 includes a latch handle 144 moveable between unlocked and locked positions for sealingly mating the harness hood 14 with the module hood 28. In the depicted exemplary embodiment, the latch handle 144 is substantially U-shaped and includes an upper latch portion 146*a* and a lower latch portion 146*b* that interface, respectively, with the upper and lower sides of the harness hood 14, strain relief backshell 22, and module hood 28. The latch handle 144 is substantially symmetrical about a center horizontal plane, with the upper and lower latch portions 146*a* and 146*b* being substantially identical. Therefore, only the upper latch portion 146*a* will be described in detail, with identical features on the lower latch portion 146*b* labeled with identical reference numerals except with a "b" designation. Moreover, for ease of description and illustration, some of the "b" designation features are not described or shown in detail since the identical "a" feature is shown and described. Likewise, some of the "a" designation features are not described or shown in detail since the identical "b" feature is shown and described. Finally, some features may be generally described without the "a" or "b" designation when generally describing the part for both the upper and lower latch portions 146*a* and 146*b*.

As noted above, the latch handle 144 is moveable between unlocked and locked positions for sealingly mating the harness hood 14 with the module hood 28. More particularly, the latch handle 144 is pivotally secureable to the harness hood 14 and configured to selectively latch onto the module hood 28 for sealingly mating the harness hood 14 with the module hood 28. In that regard, the latch handle 144 is moveable between a first unlocked position, where the harness hood 14 is in an initial, unsealed mating position relative to the module hood 28 (see FIG. 5), and a second locked position, where the harness hood 14 is sealingly mated with the module hood 28 (see FIGS. 2 and 3).

Figure 4:
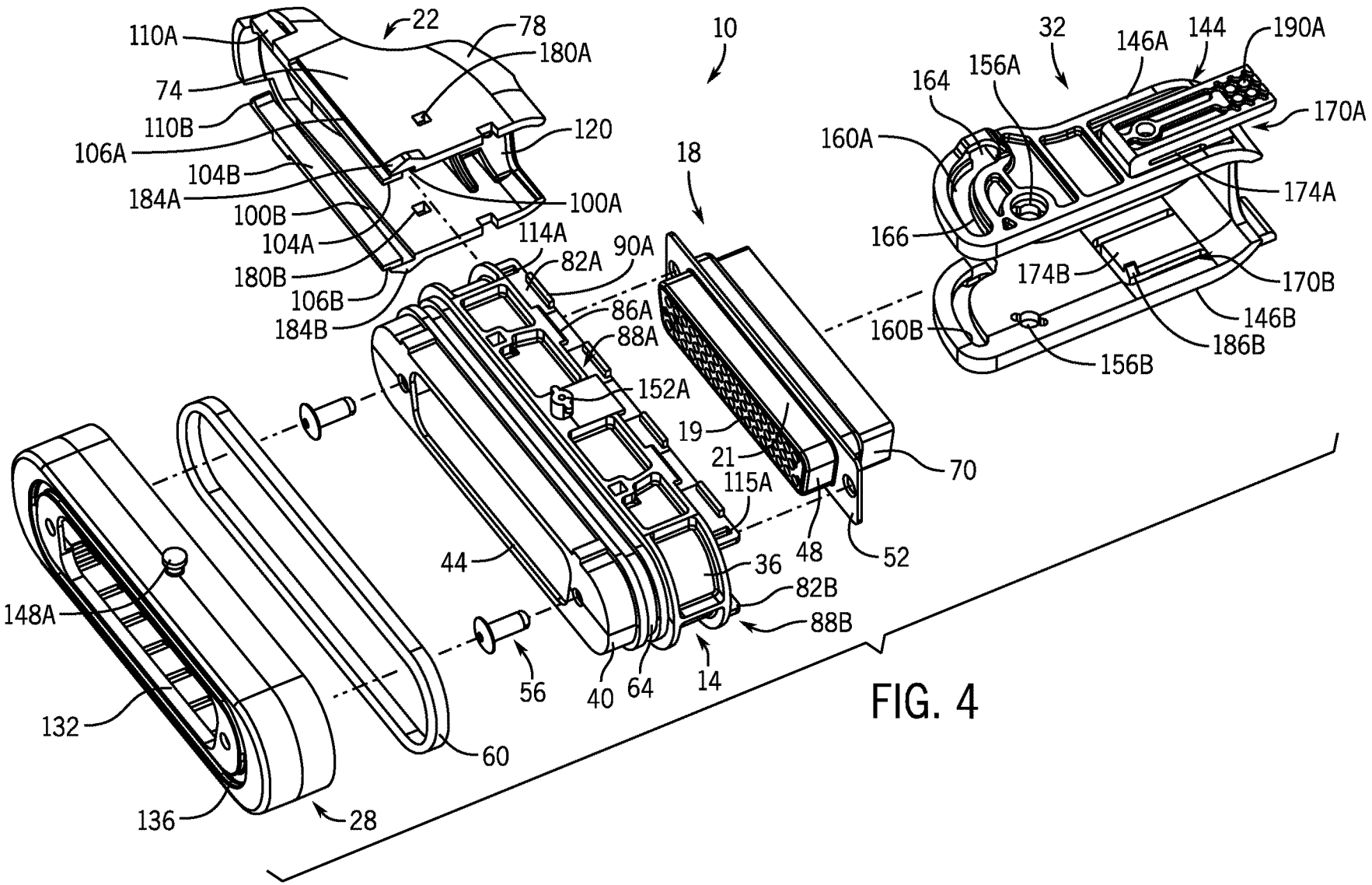
FIG. 4 is an exploded isometric view of the connector backshell assembly of FIG. 1.

The manner in which the latch handle 144 is pivotally secured to the harness hood 14 will first be described. Referring to FIG. 4, the upper latch portion 146*a* of the latch handle 144 includes a keyed hole 156*a* that receives a corresponding key 152*a* extending from an exterior upper surface of the harness hood 14. The lower latch portion 146*b* is pivotally mated with a lower side of the harness hood 14 in an identical manner.

Figure 5:
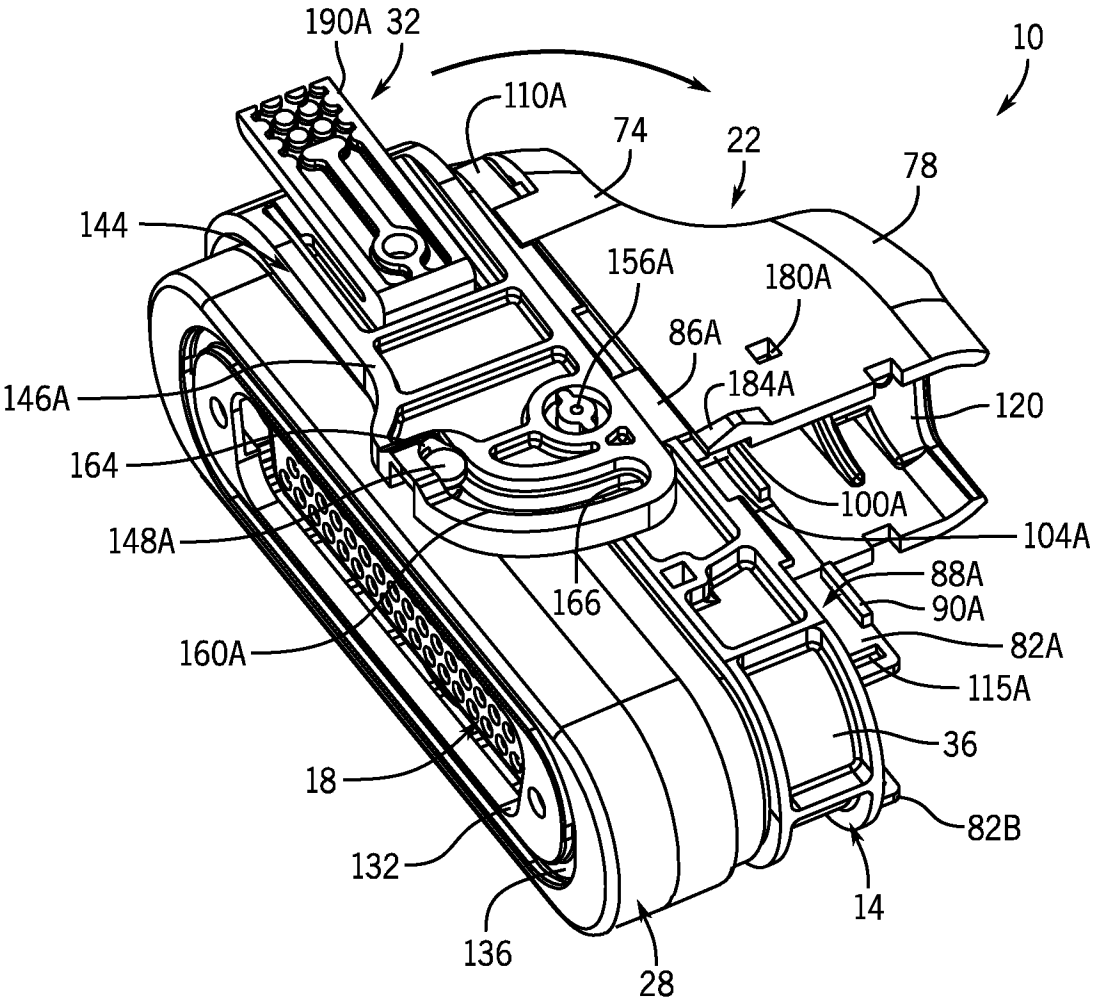
FIG. 5 is a front isometric view of the connector backshell assembly of FIG. 1, wherein the latch is shown in an unlatched position.

The key 152*a* is oriented to receive the keyed hole 156*a* of the latch handle 144 in the first unlocked position, as shown in FIG. 5. In the first unlocked position, the upper latch portion 146*a* extends along the length of the harness hood 14. The key 152*a* is also oriented to receive the keyed hole 156*a* of the upper latch portion 146*a* in an opposite, mirrored unlocked position. In that regard, the latch handle 144 is pivotally secureable to the harness hood 14 in a right-handed or left handed configuration.

As the latch handle 144 is turned relative to the harness hood 14, the keyed interface of the key 152 and hole 156 retains the upper and lower latch portions 146*a* and 146*b* of the latch handle 144 pivotally secured to the harness hood 14. As the latch handle 144 is pivoted into the locked position, it interfaces with the module hood 28 to draw the harness hood 14 into the module hood 28.

The manner in which the latch handle 144 interfaces with the module hood 28 to draw the harness hood 14 into the module hood 28 will now be described. In the depicted exemplary embodiment, the upper latch portion 146*a* includes a latching slot 160*a* defined at its proximal end that is shaped to receive and translate against a locking nub 148*a* extending from an exterior upper surface of the module hood 28. Similarly, the lower latch portion 146*b* includes a latching slot 160*b* defined at its proximal end that is shaped to receive and translate against a locking nub 148*b* extending from an exterior lower surface of the module hood 28.

The latching slot 160 has a curved length extending between a first open end 164 and an enclosed second end 166. The first open end 164 is configured to transversely receive the respective locking nub 148 when the latch handle 144 is in the unlocked position. As the latch handle 144 is moved toward the locked position, the locking nub 148 slides within the slot 160 while being transversely retained in the slot 160. To that end, the latching slot 160 has a cross-sectional shape along its length that substantially matches the cross-sectional shape of the nub 148. In this regard, the latching slot 160 defines a keyed track for slidably retaining the locking nub 148 in the slot when the latch handle 144 is moved from the first unlocked position into the second locked position.

The latch handle 144 is moved from the first unlocked position (FIG. 5), where the locking nub 148 is receivable in the first open end 164 of the latching slot 160, and the second locked position (FIGS. 2 and 3), where the locking nub 148 is at the second enclosed end 166 of the slot 160. As the latch handle 144 is moved from the first position to the second position, the latch handle 144 pulls on the locking nub 148 to linearly draw the harness hood 14 toward the module hood 28 (with the module hood 28 normally being fixed relative to the module inlet port 12, as shown in FIG. 1). In that regard, the latching slot 160 and locking nub 148 effectively define a cam and follower, respectively of a cam assembly. The locking nub 148 travels along the path of the latching slot 160 as the latch handle 144 is rotated about the pivot point of the key 152 to linearly translate the harness hood 14 toward the module hood 28. In effect, the latch assembly 32 provides mechanical advantage for mating the connector 18 with the connector of the module inlet port 12. Moreover, with the upper and lower latch portions 146*a* and 146*b* being identical and moving in unison, a substantially evenly distributed pulling force is applied across the height of the harness hood 14 and module hood 28.

The latch handle 144 is lockable in the second position (and optionally in the first position) through a suitable locking assembly, such as a snap-fit assembly. In the depicted exemplary embodiment, a snap fit feature 170*a* is defined at the distal end of the upper latch portion 146*a* that is mateable with a corresponding feature in the strain relief portion 78 on the top of the strain relief backshell 22. Similarly, the lower latch portion 146*b* includes a snap fit feature 170*b* that is mateable with a corresponding feature in the strain relief portion 78 on the bottom of the strain relief backshell 22.

The snap fit feature 170 and how it interfaces with the strain relief backshell 22 will now be described. As can be seen in FIG. 4, a protrusion 186 extends downwardly from a deformable cantilevered piece 174 extending from the distal end of the upper or lower latch portion 146*b*. The protrusion 186 is receivable within a cutout 180 in the strain relief portion 78 of the strain relief backshell 22 when the latch handle 144 is in the second position. A travel limiter 184 may be defined on the strain relief portion 78 of the strain relief backshell 22 to prevent the latch handle 144 from moving past the second position.

The cantilevered piece 174 deforms upwardly to allow the protrusion 186 to move into and out of the cutout 180 for selectively locking the latch handle 144 relative to the strain relief backshell 22 and to provide an audible "click" when releasably locked in place. A tabbed end 190 of the cantilevered piece 174 may be depressed to urge the protrusion 186 into and out of the cutout 180.

As can be appreciated, the latch handle 144 may be moved between the unlocked and locked positions as needed to easily mate and unmate the backshell connector subassembly 130 to the module hood 28, with the snap fit feature 170 providing audible and tactile feedback of connector mating. When mated in the locked configuration, the harness hood 14 is environmentally sealed against the module hood 28 (which is environmentally sealed against the module inlet port 12). In this configuration, a widely COTS available connector may be used in harsh environments, such as those typical of aerospace vehicle builds. Moreover, the strain relief backshell 22 provides the necessary strain relief to support use of the connector in dynamic environments, such as aerospace vehicles.

The components of the connector backshell assembly 10 may be made from any suitable material and in any suitable manner. For instance, the components of the connector backshell assembly 10 may be injection molded from polycarbonate or another suitably strong and resilient plastic. Furthermore, the connector backshell assembly 10 may be made from a conductive material(s), such as plastic plated with or doped with carbon, for grounding and/or shielding functionality.

A method of sealingly mating the connector 18 with the connector of the module inlet port 12 will now be described with reference to FIGS. 1-5. The method includes sealing the module hood 28 against the connector mounting panel 134 of the module inlet port 12 with fasteners, etc. (not shown) with a radial seal (not shown) disposed therebetween.

The method also includes securing the connector 18 within the harness hood 14. In particular, the connector 18 is receivable within the body 36 of the harness hood 14 and matable against the interior of the front, module hood mating portion 40 such that the connector 18 protrudes from the harness hood 14 for mating with the module inlet port 12. The flange plate 52 of the connector 18 is secured against the interior surface of the front mating portion 40 through a plurality of fasteners, such as blind rivets 56.

With the connector 18 secured within the harness hood 14, the strain relief backshell 22 may be secured to the harness hood 14. As described above, to secure the strain relief backshell 22 on the harness hood 14, the upper and lower elongated edge portions 104*a* and 104*b* of the strain relief backshell 22 are aligned with the upper and lower tracks 88*a* and 88*b* on the harness hood 14. With the upper and lower elongated edge portions 104*a* and 104*b* aligned with and perhaps partially received within the tracks 88*a* and 88*b*, the strain relief backshell 22 may be slid into mated engagement with the harness hood 14. The upper and lower elongated edge portions 104*a* and 104*b* are slid within the upper and lower tracks 88*a* and 88*b* until the enclosed end of the harness hood mating portion 74 is substantially flush with the enclosed end of the harness hood 14.

Once slidably mated, the strain relief backshell 22 may be releasably locked onto the harness hood 14 with the snap fit assembly. For example, top and bottom snap fit features 110*a* and 110*b* mate with upper and lower openings 114*a* and 144*b* in the harness hood 14.

Figure 6:
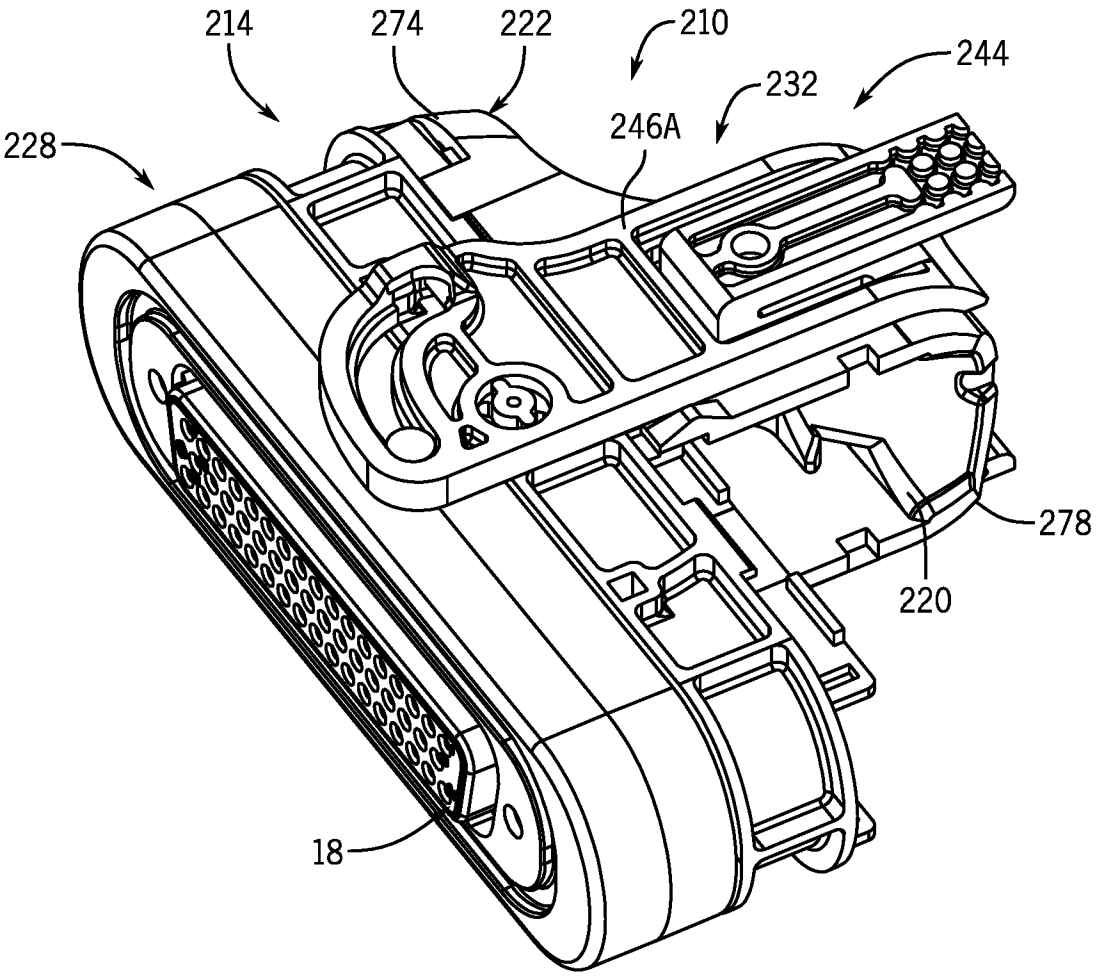
FIG. 6 is a front isometric view of a second exemplary embodiment of a connector backshell assembly, wherein the connector backshell assembly includes a latch shown in a latched position.

With the strain relief backshell 22 releasably secured on the harness hood 14, the wire harness 20 may be secured within the strain relief portion 78 of the strain relief backshell 22 to relieve any strain in the wire harness 20 and connector 18 during use. For instance, the wire may be secured against an interior semi-circular receptacle portion 120 (or 220, as shown in FIG. 6) with zip ties, a clamp, etc.

Figure 3:
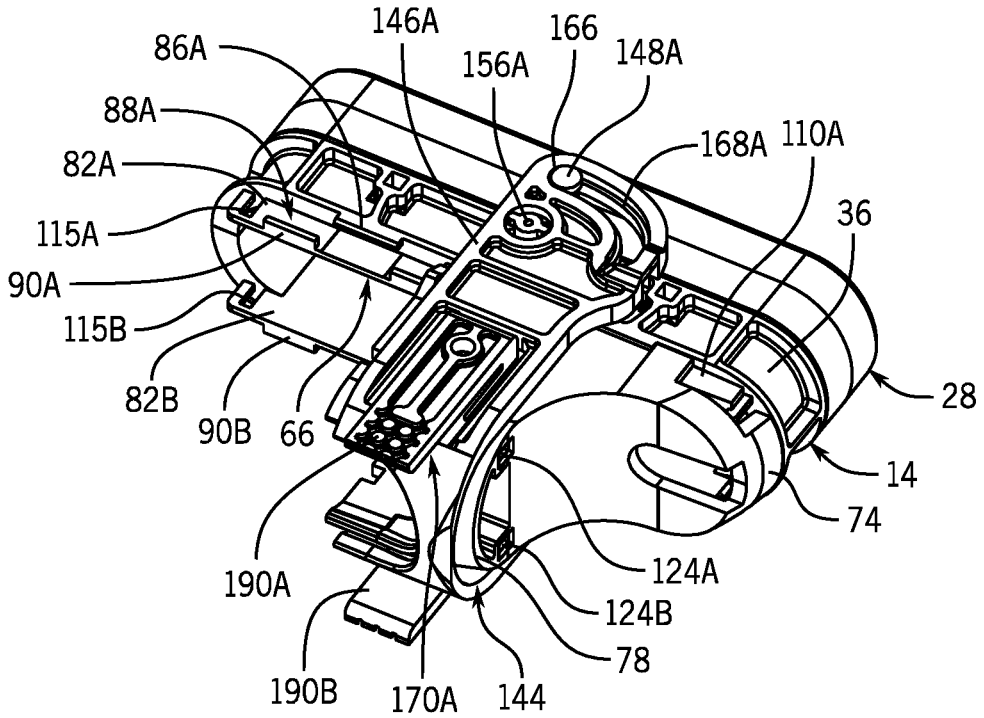
FIG. 3 is a rear isometric view of the connector backshell assembly of FIG. 1.

The terminated ends of the wire harness 20 are environmentally sealed within the harness hood 14 by disposing a sealant, or pottant within the open interior end 66 of the harness hood 14 opposite the front mating portion 40 (see FIG. 3).

With the connector 18 and wire harness 20 secured within the harness hood 14 and strain relief backshell 22, the method includes mating the connector 18 with the corresponding connector of the module inlet port 12. As noted above, the contact sockets 19 of connector 18 are mateable with contact pins of the connector of module inlet port 12*b* (or vice versa). At the same time, the male-shaped front mating portion 40 of the harness hood 14 is sized and configured to mate with or otherwise be received within a female-shaped portion of the module hood 28, with a radial seal 60 disposed therebetween. The backshell connector subassembly 130 is releasably locked onto the module hood 28 through the latch assembly 32.

In that regard, the method also includes moving the latch handle 144 from a first (right or left handed) position into a second position to move the harness hood 14 into sealing engagement with the module hood 28, and therefore moving the connector 18 into sealing engagement with the connector of the module inlet port 12. More specifically, the latch handle 144 is moved from the first unlocked position (FIG. 5), where the locking nub 148 is receivable in the first open end 164 of the latching slot 160, and the second locked position (FIGS. 2 and 3), where the locking nub 148 is at the second enclosed end 166 of the slot 160. As the latch handle 144 is moved from the first position to the second position, the latch handle 144 pulls on the locking nub 148 to linearly draw the harness hood 14 toward the module hood 28 (with the module hood 28 normally being fixed relative to the module inlet port 12, as shown in FIG. 1).

The latch handle 144 is lockable in the second position (and optionally in the first position) through a suitable locking assembly, such as a snap-fit assembly. For example, top and bottom snap fit features 170*a* and 170*b* mate with upper and lower cutouts 180*a* and 180*b* in the strain relief portion 78 of the strain relief backshell 22.

Figure 2:
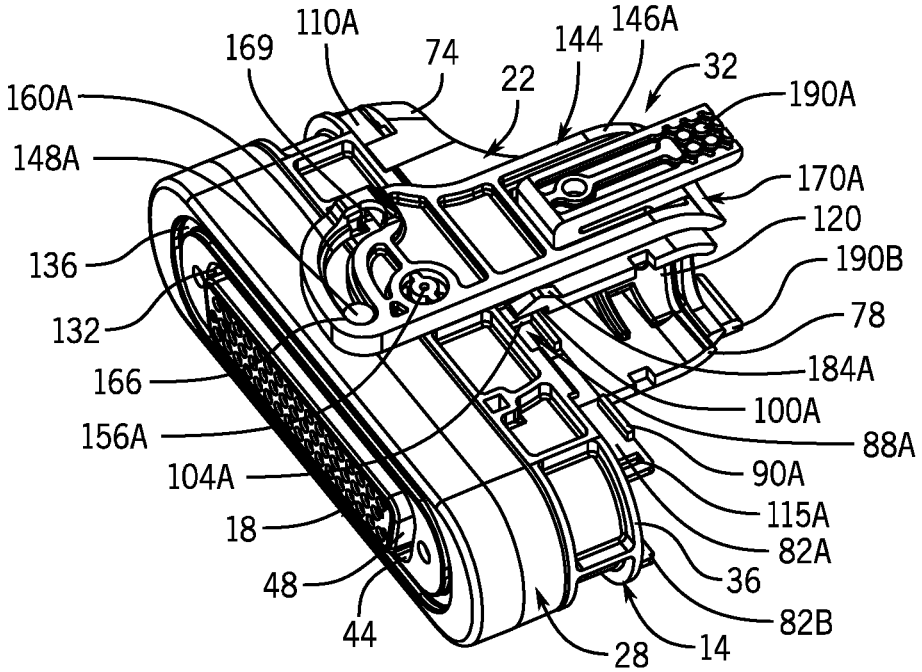
FIG. 2 is a front isometric view of the connector backshell assembly of FIG. 1, wherein the connector backshell assembly includes a latch shown in a latched position.

To disconnect the connector 18 from the connector of the module inlet port 12, the latch handle 144 is first unlocked by depressing the tabbed end 190 of the cantilevered piece 174 to urge the protrusion 186 out of the cutout 180. Once unlocked, the latch handle 144 is moved from the second locked position (FIGS. 2 and 3) into the first unlocked position (FIGS. 2 and 3). As the latch handle 144 is moved from the second position to the first position, the locking nub 148 moves toward the first open end 164 of the latching slot 160 to linearly withdraw the harness hood 14 out of the module hood 28.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C).

Language such as "top surface", "bottom surface", "vertical", "horizontal", etc., in the present disclosure is meant to provide orientation for the reader with reference to the drawings and is not intended to be the required orientation of the components or to impart orientation limitations into the claims.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, it may not be included or may be combined with other features.

While illustrative embodiments have been illustrated and described, it will be appreciated that various changes can be made therein without departing from the spirit and scope of the disclosure.

The invention claimed is:

1. A connector backshell assembly, comprising:

a module hood sealable against a connection port having a first connector;

a harness hood configured to house a second connector mateable with the first connector and having an interior surface for interfacing with and coupling to a flange plate of the first connector;

a backshell configured to provide strain relief to a wire harness extending from the second connector and securable on the harness hood after the second connector is housed within the harness hood;

a latch assembly having a latch handle moveable from a first position into a second position to move the harness hood into sealing engagement with the module hood.

2. The connector backshell assembly of claim 1, wherein the first and second connectors are D sub connectors.

3. The connector backshell assembly of claim 1, further comprising a radial seal disposed between the harness hood and the module hood and surrounding a connector opening in the harness hood.

4. The connector backshell assembly of claim 1, wherein the backshell is slidably mateable with the harness hood.

5. The connector backshell assembly of claim 4, wherein the backshell is slidably mateable with first and second opposite ends of the harness hood.

6. The connector backshell assembly of claim 4, wherein the backshell includes a strain relief portion configured to support the wire harness in one of a straight and angled position relative to the second connector.

7. The connector backshell assembly of claim 4, further comprising a snap-fit feature configured to secure the backshell in a mated configuration on the harness hood.

8. The connector backshell assembly of claim 1, wherein the latch handle is releasably and pivotally securable to the harness hood.

9. The connector backshell assembly of claim 8, wherein the latch handle is releasably and pivotally securable to the harness hood in a right handed or left handed configuration.

10. The connector backshell assembly of claim 8, further comprising a sealant disposed within the harness hood and surrounding the second connector and at least a portion of the wire harness.

11. The connector backshell assembly of claim 8, wherein the latch handle is moveable against a nub on the module hood for drawing the harness hood into sealing engagement with the module hood.

12. The connector backshell assembly of claim 11, wherein the latch handle is releasably engageable with the nub in the first position.

13. The connector backshell assembly of claim 11, wherein the latch handle includes a slot mateable with the nub, wherein the harness hood is drawn into sealing engagement with the module hood as the latch handle moves from the first position into the second position and the nub follows a path of the slot.

14. The connector backshell assembly of claim 8, further comprising a locking assembly configured to releasably lock the latch handle in the second position.

15. The connector backshell assembly of claim 14, wherein the locking assembly is a snap fit assembly defined between the latch handle and the backshell.

16. A D-Sub connector backshell assembly, comprising:

a module hood sealable against a connection port having a first D-Sub connector;

a harness hood configured to house a second D-Sub connector mateable with the first D-Sub connector and having an interior surface for interfacing with and coupling to a flange plate of the first D-Sub connector;

a backshell configured to provide strain relief to a wire harness extending from the second D-Sub connector and securable on the harness hood; and a latch assembly having a latch handle moveable from a first position into a second position to move the harness hood into sealing engagement with the module hood.

17. The connector backshell assembly of claim 16, wherein the backshell is slidably mateable with the harness hood.

18. The connector backshell assembly of claim 16, further comprising a radial seal disposed between the harness hood and the module hood and surrounding a D-Sub connector opening in the harness hood.

19. The connector backshell assembly of claim 16, wherein the latch handle is releasably and pivotally securable to the harness hood.

20. The connector backshell assembly of claim 19, wherein the latch handle is releasably and pivotally securable to the harness hood in a right handed or left handed configuration.

* * * * *